US011160423B2

(12) United States Patent
Marshall

(10) Patent No.: US 11,160,423 B2
(45) Date of Patent: Nov. 2, 2021

(54) DISPENSER

(71) Applicant: Brightwell Dispensers Limited, Newhaven (GB)

(72) Inventor: Andrew Timothy Marshall, Newhaven (GB)

(73) Assignee: Brightwell Dispensers Limited, Newhaven (GB)

( * ) Notice: Subject to any disclaimer, the term of this patent is extended or adjusted under 35 U.S.C. 154(b) by 0 days.

(21) Appl. No.: 16/855,895

(22) Filed: Apr. 22, 2020

(65) Prior Publication Data

US 2020/0337506 A1 Oct. 29, 2020

(30) Foreign Application Priority Data

Apr. 25, 2019 (GB) ..... 1905786

(51) Int. Cl.
*A47K 5/12* (2006.01)

(52) U.S. Cl.
CPC ..... *A47K 5/1207* (2013.01); *A47K 2201/025* (2013.01)

(58) Field of Classification Search
CPC .. A47K 5/1207; A47K 5/12; A47K 2201/025; A47K 2201/02
USPC ..... 222/153.03, 153.04, 181.3, 182
See application file for complete search history.

(56) References Cited

U.S. PATENT DOCUMENTS

| | | | | |
|---|---|---|---|---|
| 6,772,916 | B1 * | 8/2004 | Reynolds | A47K 5/1202 221/154 |
| 8,561,847 | B2 * | 10/2013 | Rosenkranz | A47K 10/38 222/153.03 |
| 2005/0284888 | A1 | 12/2005 | Rhodenbaugh | |
| 2006/0213929 | A1 | 9/2006 | Ophardt et al. | |
| 2010/0072227 | A1 * | 3/2010 | Cittadino | A47K 10/32 222/153.03 |
| 2013/0292417 | A1 * | 11/2013 | Pelkey | E05B 1/0038 222/153.03 |

FOREIGN PATENT DOCUMENTS

WO WO 2013/165994 11/2013

* cited by examiner

*Primary Examiner* — Lien M Ngo
(74) *Attorney, Agent, or Firm* — Levy & Grandinetti

(57) ABSTRACT

A dispenser has a fastening mechanism having a fastened configuration that fastens a cover of the dispenser to a base of the dispenser, and an unfastened configuration that allows the cover to open from the base. The fastening mechanism has a locked state in which the fastening mechanism requires a key to move from the fastened configuration to the unfastened configuration and an unlocked state in which the fastening mechanism is movable from the fastened configuration to the unfastened configuration without the presence of the key. A release member is actuable by a button without the presence of the key to open the dispenser when the fastening mechanism is in the unlocked state, and the release member is actuable by the key to disengage the release member from the cooperating member when the fastening mechanism is in the locked state.

19 Claims, 6 Drawing Sheets

DISPENSER

FIELD OF THE INVENTION

The present invention relates to a dispenser, and more specifically to a dispenser comprising a base and a cover that define a cavity between them for storing a material to be dispensed.

BACKGROUND OF THE INVENTION

Dispenser devices are commonly used in situations where materials are to be dispensed to users in relatively small quantities from a store or reservoir of the material held inside the dispenser. For example, common dispenser devices are liquid soap dispensers or paper towel dispensers.

When the material inside the dispenser has been exhausted, the material needs to be replenished, typically by opening the cover of the dispenser and adding new material. This replenishment is typically carried out by maintenance staff, and there is a desire to make opening of the cover as easy as possible. However, one of the problems with making the cover easy to open is that the dispenser become susceptible to opening by unauthorised users, for example users who have not been appropriately trained, or by unscrupulous users who seek to steal all the material stored inside the dispenser or to cause damage.

It is known to provide dispensers that require a key to open them, however keys are often undesirable for maintenance purposes, since they slow the opening of the dispenser and require maintenance staff to carry and avoid losing the keys.

It is therefore an object of the invention to provide an improved dispenser.

SUMMARY OF THE INVENTION

According to the invention, there is provided a dispenser comprising a base and a cover that define a cavity between them for storing a material to be dispensed, a fastening mechanism that is movable between a fastened configuration that fastens the cover to the base, and an unfastened configuration that allows the cover to open from the base for replenishing the material to be dispensed. The fastening mechanism comprises a locked state in which the fastening mechanism requires a key to move from the fastened configuration to the unfastened configuration, and an unlocked state in which the fastening mechanism is movable from the fastened configuration to the unfastened configuration without the presence of the key. The fastening mechanism comprises a button, a release member, and a cooperating member, wherein the release member engages with the cooperating member in the fastened configuration to prevent the cover opening from the base, and wherein the release member disengages from the cooperating member in the unfastened configuration to allow the cover to open from the base. The release member is actuable by the button without the presence of the key to disengage the release member from the cooperating member when the fastening mechanism is in the unlocked state, and the release member is actuable by the key to disengage the release member from the cooperating member when the fastening mechanism is in the locked state.

Since the release member is actuable by the button in the unlocked state, the dispenser may be permanently left in the unlocked state if the users of the dispenser are trusted not to steal from or damage the dispenser. Then, maintenance staff do not require any keys to replenish the material stored inside the dispenser. If the dispenser needs to be lockable, for example if the dispenser is installed in a public place, then the fastening mechanism can be put into the locked state in which the key is required to actuate the release member, and the button alone is not sufficient.

Therefore, the release member is actuable by the button and/or the key to open the dispenser, depending on whether the fastening mechanism is locked or unlocked. In the unlocked state, either the button or the key may be useable to actuate the release member and open the dispenser, but since the button can be used to open the dispenser without the key, the key is not required.

The key is preferably a device formed in a shape that most users of the dispenser will not be able to casually imitate. For example, the dispenser may be designed for use with keys that have two separate prongs spaced apart from one another, the two prongs being insertable into two corresponding holes of the dispenser to push against the release member and disengage it from the cooperating member. It will be appreciated that the key is a separate device from the dispenser, and that some purchasers of the dispenser may not purchase or utilise any keys if they have no interest in being able to lock the dispenser.

The button is actuable by maintenance staff when the fastening mechanism is in the unlocked state, to actuate the release member. Actuation of the button may for example comprise pulling, pushing, sliding, or turning of the button. The button is preferably present at the exterior of the dispenser, so that it can be easily accessed and actuated.

The dispenser may only be movable between the locked and unlocked states by opening the dispenser to gain access to its interior. For example, one or more knobs, catches, or sliders may be present inside the dispenser, which can be moved to move the fastening mechanism between the locked and unlocked states, and which may only be accessible when the dispenser is opened. The key may serve an additional purpose of moving the fastening mechanism between the locked and unlocked states, in addition to being used to disengage the release member from the cooperating member when the fastening mechanism is in the locked state and the dispenser is to be opened.

In the locked state, the actuation of the button may be blocked, leaving the key as the only way of actuating the release member to open the dispenser. For example, to move into the locked state, a locking member inside the dispenser may be moved into a position to block the actuation of the button. The button may be actuable by pushing the button to move the button inwardly towards the dispenser, and the inward movement of the button may be blocked in the locked state.

The fastening mechanism may comprise a lock track and the button may comprise a locking member that is configured to move along the lock track during actuation of the button. The lock track may comprise a catch that is configured to restrain movement of the locking member along the lock track when the fastening mechanism is in the locked state, and so prevent actuation of the button. Accordingly, movement of the catch, or movement of the locking member beyond the catch, may be utilised to move the fastening mechanism into the unlocked state where the locking member is free to move along the reminder of the lock track.

The lock track may comprise an enclosure in which the locking member is constrained to move, and the enclosure may comprise an opening into which the key can be inserted to move the locking member between the first and second regions. Since the key is needed to actuate the release member when the fastening mechanism is in the locked state, it is convenient to give the key the additional function of moving the fastening mechanism between the locked and unlocked states, rather than needing to provide a tool for this.

To help the button automatically return to its un-actuated position after it has been actuated, the locking member is configured to flex as it travels along the lock track when the button is actuated, thereby exerting a force against the actuation of the button. This force returns the button to its un-actuated position after the button has been released by the user.

The release member may be formed on the base of the dispenser, as a base catch, or the release member may be formed on the cover of the dispenser, as a cover catch. Equivalently, the cooperating member may be formed on the cover of the dispenser, as a cover catch, or the cooperating member may be formed on the base of the dispenser, as a base catch. The button may be mounted on the base or the cover of the dispenser, as desired. The actuation of the release member by the button may comprise the button pushing against the release member to flex the release member out of engagement from the cooperating member. In the unlocked state, either the key or the button may be used to push against the release member and flex/deflect the release member out of engagement from the cooperating member, but in the locked state the actuation of the button may be blocked, and so only the key may be usable to flex/deflect the release member.

The base and cover may for example be connected by a hinge at a bottom and of the dispenser, and by the fastening mechanism at a top end of the dispenser, so the cover portion hinges away from the base portion to open the dispenser when the fastening mechanism is moved to the unfastened configuration. The base may for example form a wall plate for mounting the dispenser on a wall, and the cover may form an outer housing of the dispenser.

DETAILED DESCRIPTION

Embodiments of the invention will now be described by way of non-limiting example only and with reference to the accompanying drawings, in which.

The figures are not to scale, and same or similar reference signs denote same or similar features.

Figure 1:
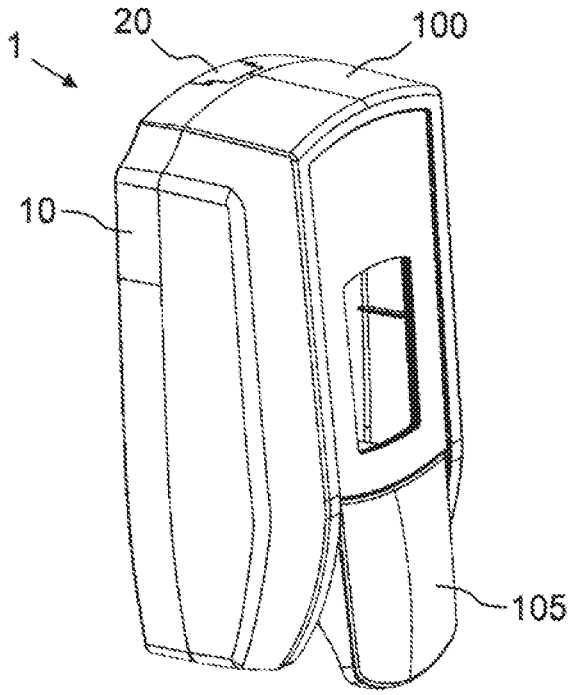
FIG. 1 shows a schematic perspective diagram of a dispenser according to an embodiment of the invention, the dispenser comprising a cover that is closed to a base.

An embodiment of the invention will now be described with reference to FIGS. 1 to 14, which show a dispenser device 1 and a key 200 for use with the dispenser device. The schematic diagram of FIG. 1 shows the dispenser 1 comprising a base 10 and a cover 100. The base 10 is a wall plate that is for mounting to a wall of a building, for example in a bathroom. The cover 100 defines a cavity in which a store of material (not shown in Figs) is held between the base and the cover. In this embodiment, the cavity is primarily defined by the cover, but the base could define most of the cavity in alternative embodiments.

Figure 2:
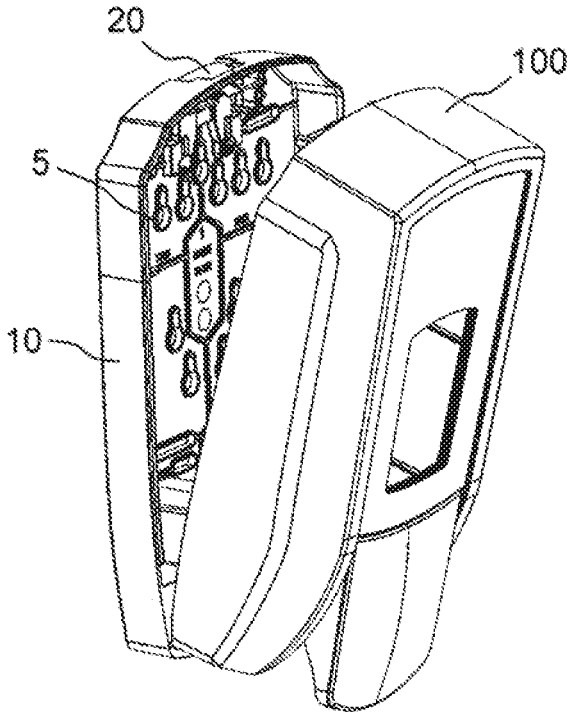
FIG. 2 shows a schematic perspective diagram of the dispenser of FIG. 1 with the cover opened from the base.

The cover 100 comprises a paddle 105 towards the bottom of the dispenser, and the paddle can be pushed by a user of the dispenser to dispense material. In this particular embodiment, the dispenser 1 is a liquid soap dispenser, and so pressing the paddle 105 causes soap to be dispensed out the bottom of the dispenser, from a store of soap inside the dispenser. The base 10 is attached to the cover 100 by a hinge (not shown in Figs) at the bottom of the dispenser. The hinge allows the cover to open away from the base, to the configuration shown in FIG. 2. Then, once the soap has been exhausted from the store, the store can be replenished with more soap. As seen in FIG. 2, the wall plate comprises various mounting holes 5 to allow the base 10 to be mounted to the wall.

To control the opening and closing of the cover from the base, the dispenser comprises a fastening mechanism which is movable between a fastened configuration (shown in FIG. 1) to an unfastened configuration (shown in FIG. 2). More specifically, the fastening mechanism comprises a button 20, which is shown in a normal, unactuated, position in FIG. 1, and in an actuated position in FIG. 2, which has allowed the cover 100 to hinge away from the base 10. Firstly, the movement of the button 20 will be described in detail with reference to FIGS. 3 to 11, and then the ways in which the button and key can be used to move the dispenser between the fastened and unfastened positions described later on.

Figure 3:
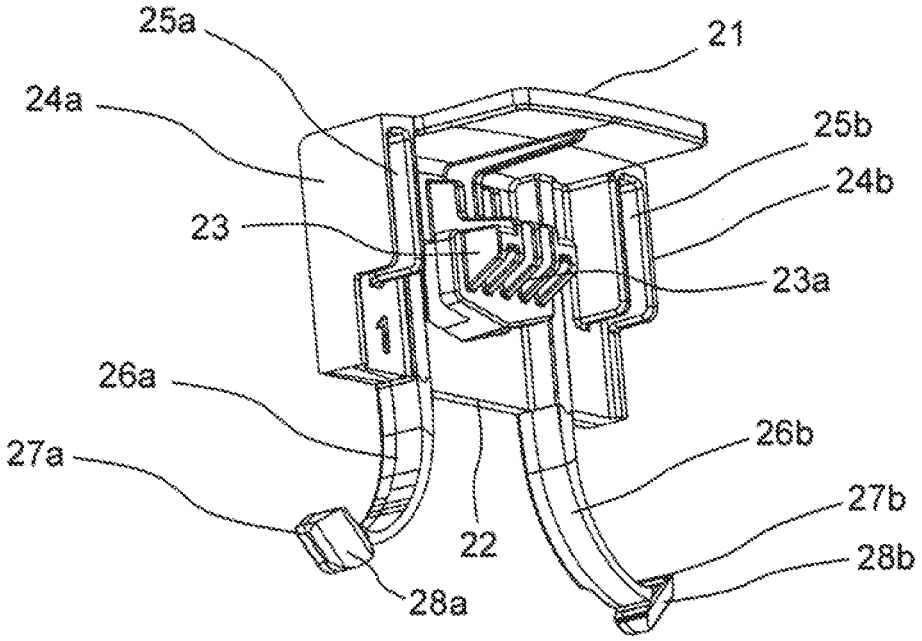
FIG. 3 shows a schematic perspective diagram of a button forming part of a fastening mechanism of the dispenser of FIG. 1.

The schematic diagram of FIG. 3 shows the button 20 in isolation from the rest of the dispenser. The button 20 comprises an upper plate 21 that forms part of the upper surface of the dispenser, and a rearward plate 22 extending downwardly from the upper plate 21, perpendicular to the upper plate 21. The rearward plate 22 forms part of the rearward surface of the dispenser that faces toward the wall of the building in which the dispenser is installed. A hammer 23 extends from the centre of the rearward plate, perpendicularly from the rearward plate and in a forward direction, parallel to the upper plate 21. A lower surface 23*a* of the hammer ramps upwardly as the hammer extends away from the rearward plate 22.

Two side portions 24*a* and 24*b* also extend from the upper and rearward plates 21 and 22, perpendicular to the upper and rearward plates 21 and 22, at opposing sides of the plates 21 and 22. The side portions 24*a* and 24*b* each define respective channels 25*a* and 25*b*, the channels extending downwardly from the upper plate 21, and being open towards the front of the dispenser.

The button 20 also comprises two locking members 26*a* and 26*b*. The locking members are integrally formed as part of the button, and extend downwardly from the rearward plate 22 at opposite sides to the hammer 23 from one another. The locking members are formed of a flexible material such as a plastic, and both curve outwardly away from the hammer 23, in opposite directions to one another, and in a same plane as the plane of the rearward plate 22.

Each of the locking members 26*a* and 26*b* comprise distal ends having wedges 27*a* and 27*b*, and ramps 28*a* and 28*b*, respectively. Each wedge has an outer surface facing outwardly in sideward/upward directions depending on how far the locking member is flexed, and each ramp has an outer surface facing in a forward and downward direction in the position shown.

Figure 4:
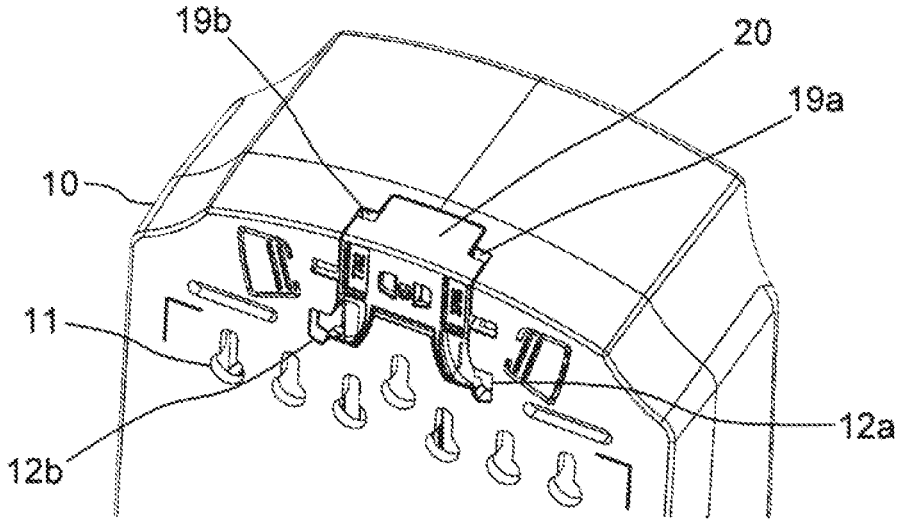
FIG. 4 shows a schematic perspective diagram of a top portion of the dispenser in a fastened configuration, with the fastening mechanism in a locked state.

FIG. 4 shows a schematic perspective diagram of a top portion of the dispenser 1 in the fastened configuration, with the fastening mechanism in the locked state. FIG. 4 shows a view from the rear of the dispenser, where mounting holes 11 for screws are visible in the base 10 of the dispenser. The button 20 is shown fitted into an aperture in the top surface of the base 10 of the dispenser, at the rear of the dispenser. The button is in a raised position, with the upper surface of the upper plate 21 being flush with the upper surface of the base 10. There are two holes 19*a* and 19*b* passing through the base 10 at opposite sides of the button 20. The hole 19*a* leads into the channel 25*a* (see FIG. 3), and the hole 19*b* leads into the channel 25*b* (see FIG. 3).

The base 10 comprises a lock track 12*a* along which the locking member 26*a* is slidable, and also a lock track 12*b* along which the locking member 26*b* is slidable. The locking members slide along the lock tracks when the button 20 is pushed and moved downwardly. Since the lock tracks curve outward towards the sides of the base 10 along their lengths, the locking members are flexed outwardly along the lock tracks when the button 20 is pressed and moved downwards. The un-flexed curvature of the locking members biases the button in the raised position shown in FIG. 4.

Figure 5:
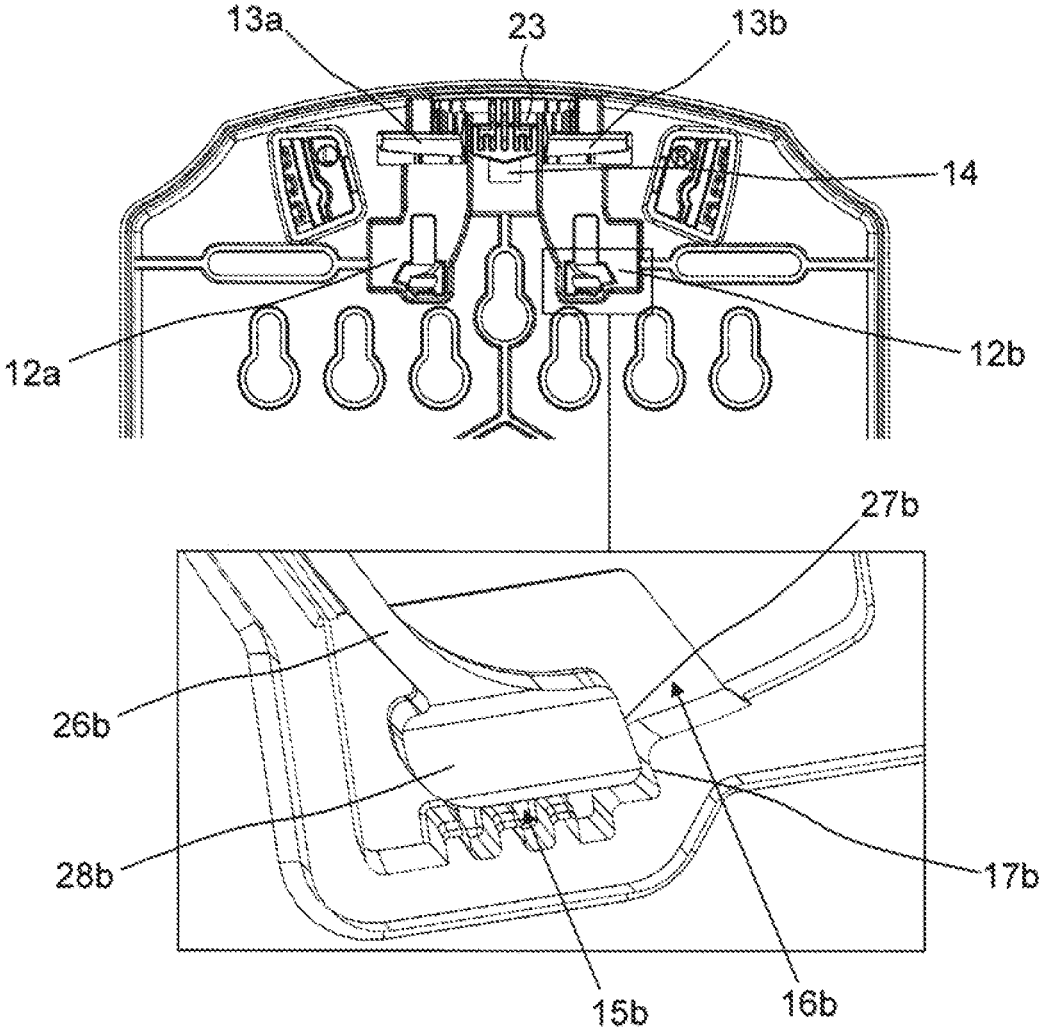
FIG. 5 shows a schematic side diagram of the top portion of the base of the dispenser in the fastened configuration, with a locking member and a lock track of the fastening mechanism in the locked state as shown in an enlarged view.
Figure 11:
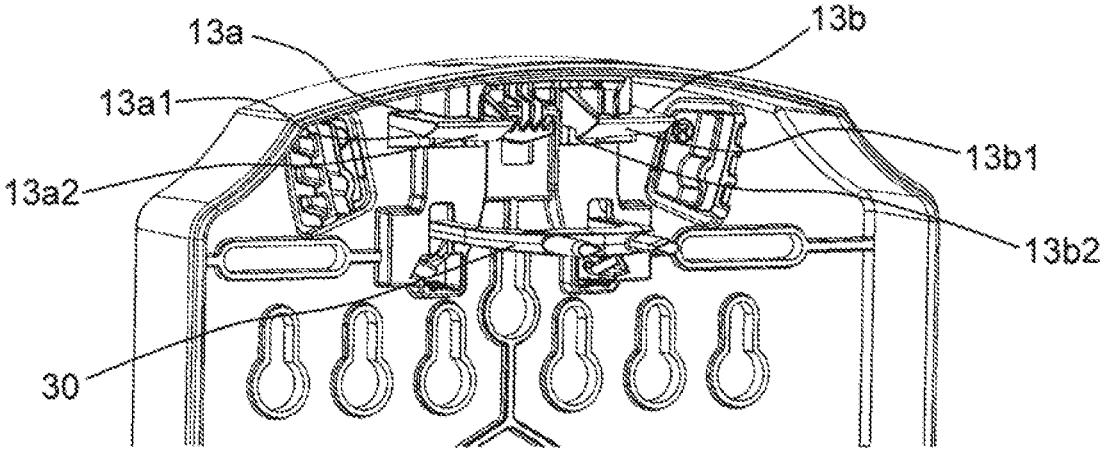
FIG. 11 shows a schematic perspective diagram of the top portion of the base when viewed from the interior of the dispenser with the cover opened from the base, and the key being used to move the fastening mechanism from the unlocked to the locked state.

FIG. 5 shows a schematic side diagram of the top portion of the base of the dispenser in the fastened configuration, in which details of the locking members and lock tracks can be seen more easily. Note that the base 10 is being viewed from the front of the dispenser in FIG. 5, rather than from the rear as in FIG. 4, with the cover 100 omitted for clarity. As seen in FIG. 5, the base portion 10 comprises two base catches 13*a* and 13*b* that constitute cooperating members of the fastening mechanism, and which are also seen in FIG. 11. The base catches 13*a* and 13*b* are positioned on opposing sides of the hammer 23 of the button 20 to one another, and each catch comprises a downward protrusion that ramps downwardly from the front to the rear of the base 10. The base 10 has a slot 14, allowing the base of the hammer 23 to move down the slot when the button 20 is pushed and moved downwardly.

The locking members 26*a* and 26*b* slide within the lock channels 12*a* and 12*b*, respectively, and as can be seen in the enlarged portion of FIG. 5, the distal end of the locking member 26*b* is shown caught in a first region 15*b* of the lock track 12*b*, meaning the fastening mechanism is in the locked state. Specifically, the lock track comprises a catch 17*b* with a face that faces inwardly towards the distal end of the locking member, and the face of the wedge 27*b* abuts against the face of the catch 17*b*. The faces of the wedge and the catch are set at an angle that means the face of the wedge 27*b* will not move beyond the face of the catch 17*b*. The lock track 12*b* comprises a second region 16*b*, and the catch 17*b* prevents the distal end of the locking member 26*b* from moving into that second region. Accordingly, this prevents the button 20 from being moved downwardly, and so the fastening mechanism is in the locked state. In the same manner, the distal end of the locking member 26*a* is caught in a first region of the lock track 12*a* by a catch similar to the catch 17*b*, also helping to lock the button 20 in position and prevent it from being moved downwardly.

Figure 6:
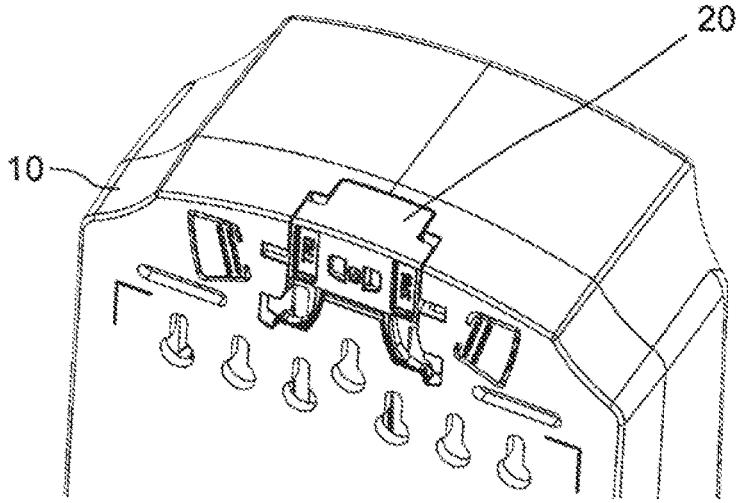
FIG. 6 shows a schematic perspective diagram of the top portion of the dispenser in the fastened configuration with the fastening mechanism in an unlocked state.
Figure 7:
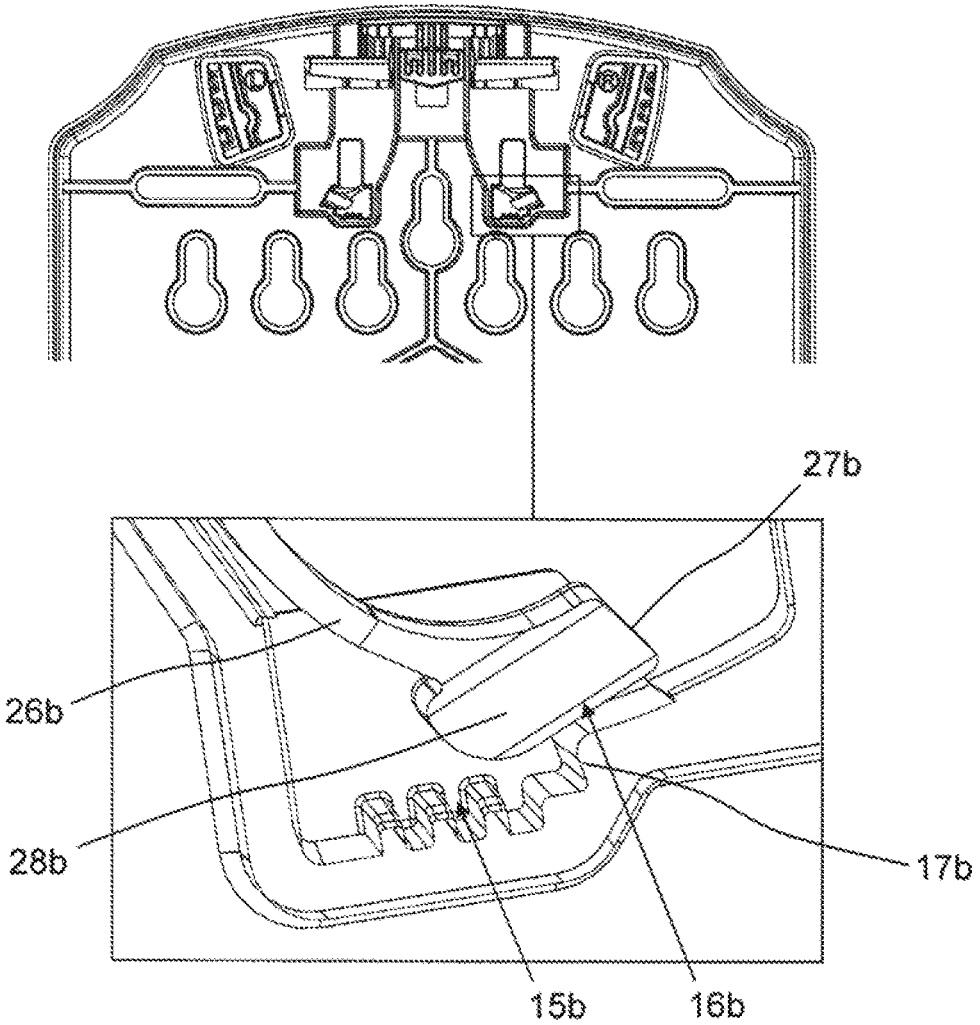
FIG. 7 shows a schematic side diagram of the top portion of the base of the dispenser in the fastened configuration, with the locking member and the lock track of the fastening mechanism in the unlocked state as shown in an enlarged view.

FIGS. 6 and 7 show the same views as FIGS. 4 and 5, but with the fastening mechanism in an unlocked state where the distal ends of the locking members 26*a* and 26*b* have been moved beyond the catches of the lock tracks, and into the second regions. The button 20 is still in its raised position, as shown in FIG. 6, but the wedge faces of the locking members have been moved out of engagement from the ramped faces of the catches of the lock tracks, and so the distal ends of the locking members are now free to move along the lock tracks within the second regions.

This is most easily seen in the expanded portion of FIG. 7, showing that the distal end of the locking member 26*b* has now moved beyond the catch 17*b*, and into the second region 16*b*. Since there is nothing to stop the distal end of the locking member 26*b* from moving along the lock track 12*b* within the second region, if the button 20 is pushed downwardly, then the button will move downwardly with the locking members moving along the lock tracks.

Figure 8:
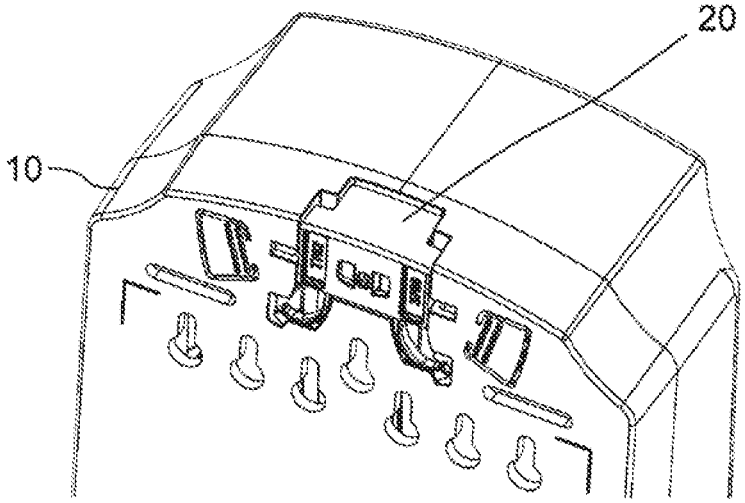
FIG. 8 shows a schematic perspective diagram of the top portion of the dispenser when moved into an unfastened configuration by depressing a button, with the fastening mechanism in the unlocked state.
Figure 9:
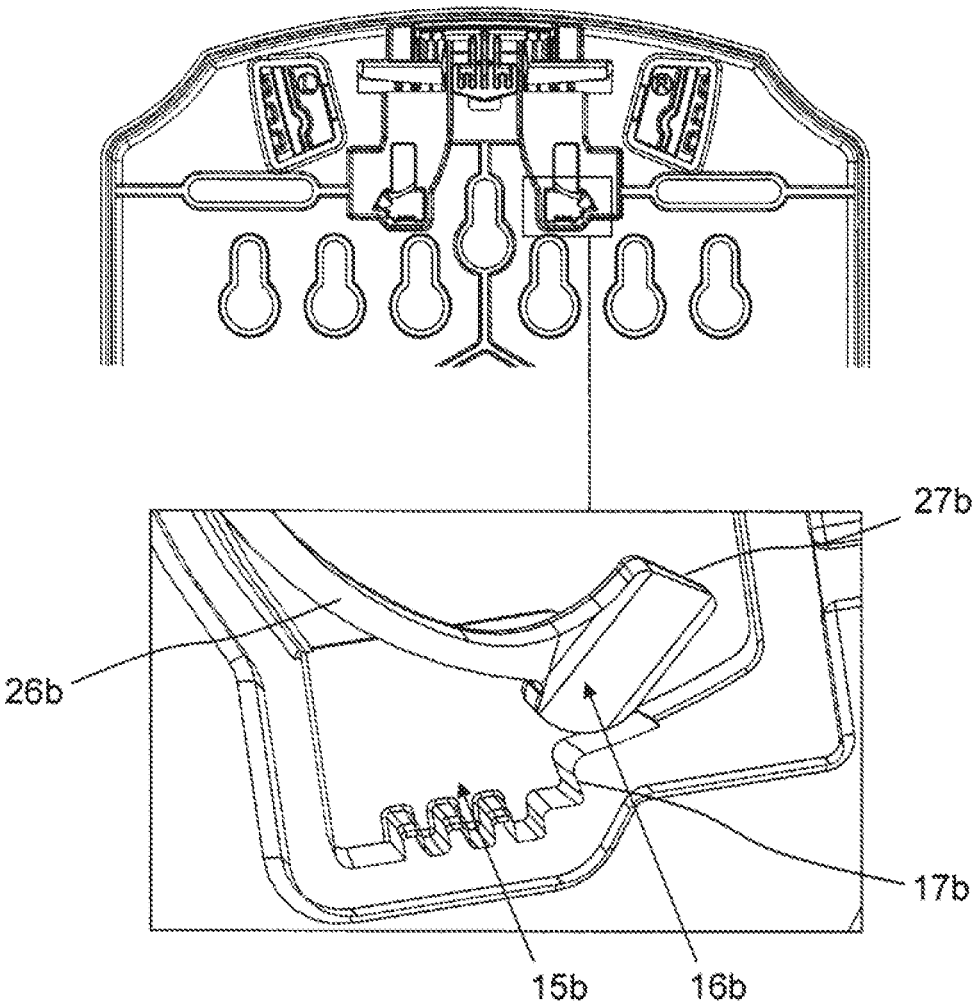
FIG. 9 shows a schematic side diagram of the top portion of the base of the dispenser in the unfastened configuration, with the locking member and the lock track of the fastening mechanism in the unlocked state as shown in an enlarged view.

FIGS. 8 and 9 also show the same views as FIGS. 6 and 7, but where the button 20 has been pressed and moved downwardly (as shown in FIG. 8), and the distal ends of the locking members flexed outwardly and moved along the lock tracks (as shown in FIG. 9) as a result of the button being moved downwardly. When the button is released, it will move back to the raised position, under the force of the locking members flexing back to their neutral (un-flexed) positions shown in FIG. 7.

The fastening mechanism can be moved between the locked and unlocked states by moving the distal ends of the locking members beyond the catches of the lock tracks, from the first regions to the second regions. To move the distal ends in that manner, they can be accessed from inside of the dispenser when the dispenser is in the unfastened configuration shown in FIG. 2.

Figure 10:
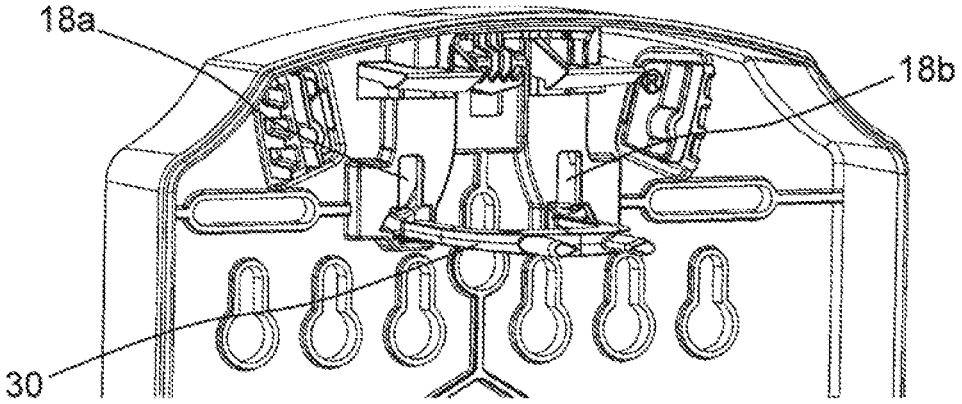
FIG. 10 shows a schematic perspective diagram of a top portion of the base when viewed from an interior of the dispenser with the cover opened from the base, and the key being used to move the fastening mechanism from the locked to the unlocked state.

As shown in FIG. 10, the enclosure of each lock track 12*a* and 12*b* has an opening in the form of a slot 18*a* and 18*b*, which allows the lock member inside the lock track to be accessed from within the dispenser whilst the dispenser is open. When the distal ends of the locking members are in the first regions, corresponding to the locked state, the two ends of a U-shaped key 30 can be inserted into the two slots 18*a* and 18*b*, and pushed against the ramps 28*a* and 28*b* (see FIGS. 3 and 5) to force the distal ends of the locking members upwardly out of engagement with the catches of the locking tracks, and into the second regions.

Similarly, as shown in FIG. 11, when the distal ends of the locking members are in the second regions, corresponding to the unlocked state, the two ends of the U-shaped key 30 can be inserted into the two slots 18*a* and 18*b* at a point above the distal ends of the locking members, and the two ends of the key 30 can be slid downwardly along the slots 18*a* and 18*b*, to force the distal ends of the locking members downwardly into engagement with the catches of the locking tracks, and into the first regions to lock the fastening mechanism.

Figure 12:
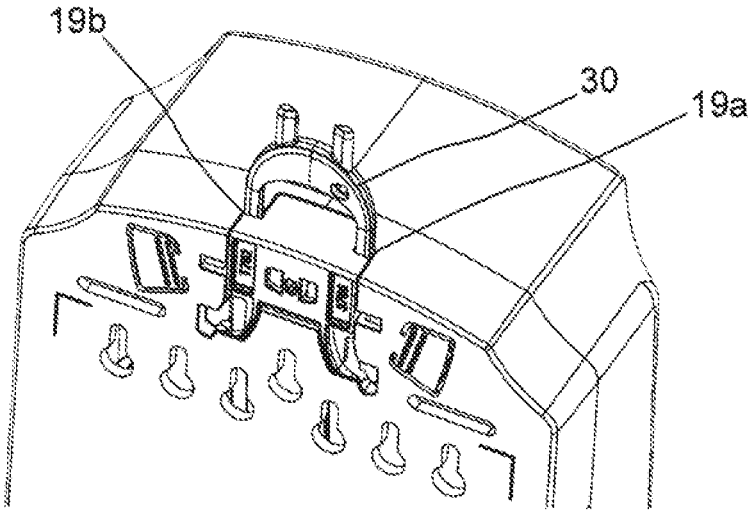
FIG. 12 shows a schematic perspective diagram of the top portion of the dispenser when moved into the unfastened configuration by using a key, with the fastening mechanism in the locked state.

The two slots 18*a* and 18*b*, and therefore the two ends of the U-shaped key 30, are spaced apart from one another by the same distance as the holes 19*a* and 19*b* that pass through the base 10 at opposite sides of the button 20 (as shown in FIG. 4). Therefore, as shown in FIG. 12, the two ends of the U-shaped key 30 can be inserted into the holes 19*a* and 19*b*, and so the key 30 can serve the dual purpose of both being used to switch between the locked/unlocked state of the fastening mechanism, and being used to move the fastening mechanism into the unfastened configuration, as will now be described.

Figure 13:
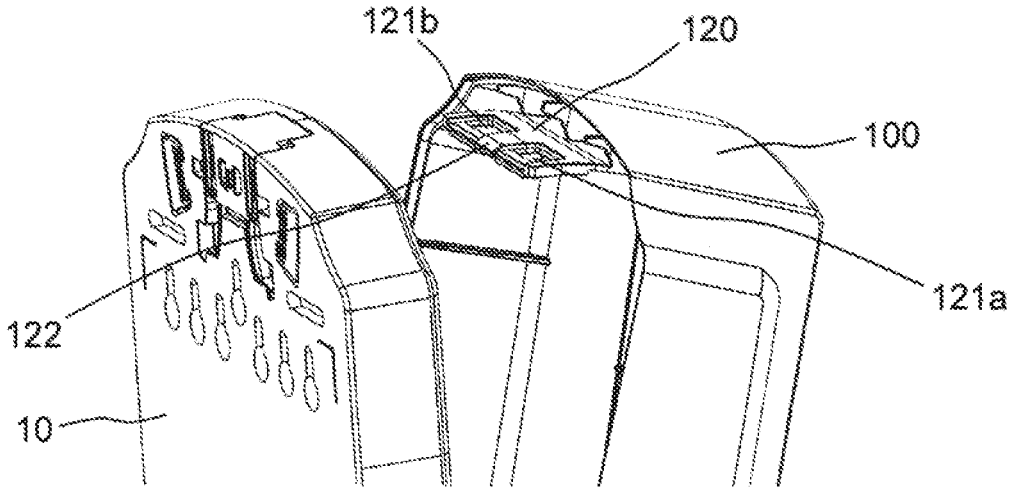
FIG. 13 shows a schematic perspective diagram of the top portion of the dispenser when the cover is open from the base.
Figure 14:
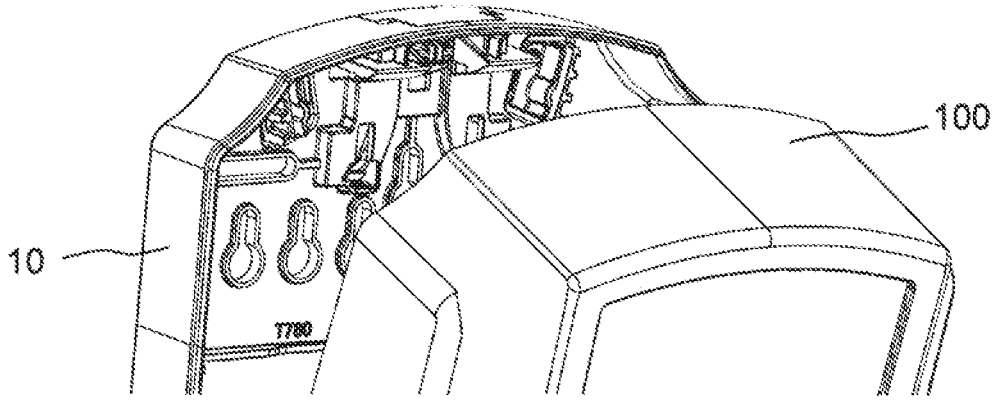
FIG. 14 shows another schematic perspective diagram of the top portion of the dispenser when the cover is open from the base.

The base catches 13*a* and 13*b* of the base 10 that are labelled in FIG. 11 have ridges 13*a*1 and 13*b*, respectively. The downward ramping protrusions 13*a*2 and 13*b*2 terminate at the ridges 13*a*1 and 13*b*1, and so the ridges provide catches for a release member (cover catch). The release member 120 is shown in FIG. 13, and is part of the cover 100. The release member 120 is for latching over the ridges 13*a*1 and 13*b*1 to fasten the cover 100 to the base 10. The release member is a flexible plate having a rearward edge 122 and two apertures 121*a* and 121*b* aligned in a row adjacent to and parallel the rearward edge 122. The rearward edge is ramped, so that when the cover 100 is closed towards the base 10, the ramped rearward edge 122 and the downward ramping protrusions 13*a*2 and 13*b*2 slide against one another to deflect the rearward edge 122 downwardly until the rearward edge 122 snaps over the ridges 13*a*1 and 13*b*1 and the downward ramping protrusions 13*a*2 and 13*b*2 locate into the apertures 121*a* and 121*b*, respectively. The fastening mechanism is then in the fastened configuration, with the cover 100 fastened to the base 10.

To unfasten the cover 100 from the base 10, the release member 120 is flexed downwardly until the apertures 121*a* and 121*b* are moved beneath the ridges 13*a*1 and 13*b*1 and the downward ramping protrusions 13*a*2 and 13*b*2, so the fastening mechanism is unfastened. The release member can be flexed downwardly in two different manners.

Firstly, pushing the button 20 to move it downwardly causes the hammer 23 (see FIG. 5) to push the rearward edge 122 of the release member downwardly, and over the ridges 13*a*1 and 13*b*1, to allow the cover 100 to be opened from the base. Since the hammer 23 acts at the centre of the rearward edge, and so the centre of the rearward edge may flex downwardly by further than either end of the rearward edge, the heights of the ridges 13*a*1 and 13*b*1 are highest at the ends of the ridges nearest to the hammer 23, and the heights of the ridges 13*a*1 and 13*b*1 reduce towards the opposite ends of the ridges, away from the hammer 23. Since the button 20 needs to be moved downwardly for this to work, the dispenser can only be opened using the button 20 when the fastening mechanism is in the unlocked state, that is when the distal ends of the locking members 26*a* and 26*b* are in the second regions where they allow the button to move.

Secondly, inserting the two ends of the U-shaped key 30 into the holes 19*a* and 19*b*, and along the channels 25*a* and 25*b* (see FIG. 3), causes the two ends of the key 30 to push against the rearward edge 122 of the release member, to force the release member downwardly. The dispenser can be opened using the key 30 regardless of whether the fastening mechanism is in the locked or unlocked states, because the positions of the distal ends of the locking members has now influence on the ability of the key to push the release member 120 downwards and out of engagement from the ridges 13*a*1 and 13*b*1, allowing the dispenser to open to the position shown in FIG. 14.

It will be appreciated that in alternate embodiments, the button 20 may act to flex the base catch, rather than the cover catch, or that the button 20 could be mounted on the cover 100 rather than the base 10. The use of one mechanism (such as a locking member and lock track) that allows the button for opening the dispenser to be enabled or disabled, and the use of another mechanism (such as the key) that allows the dispenser to be opened regardless of whether the button is enabled or disabled, and which is only distributed to authorised persons, allows the end user to choose whether or not the key should be required in order for a person to open the dispenser.

There is no need for a specific key when moving the distal ends of the locking members between the first and second regions, and any suitable means could be used.

It is possible that a single hole extending through the upper plate 21 and hammer 23 could be provided for receiving a member to push the release member downwardly, instead of providing the two separate holes 19*a* and 19*b* for a U-shaped key. In that case, any straight and narrow member capable of entering the single hole and pushing the release member downwardly could be treated as a key.

The key for pushing downward on the rearward edge 122 of the release member to allow opening of the dispenser when the fastening mechanism is in the locked state and the button is prevented from moving downward, may be made as simple or elaborate as desired.

Many other variations of the described embodiments falling within the scope of the invention will be apparent to those skilled in the art.

The invention claimed is:

1. A dispenser comprising a base and a cover that define a cavity between them for storing a material to be dispensed, a fastening mechanism that is movable between a fastened configuration that fastens the cover to the base, and an unfastened configuration that allows the cover to open from the base for replenishing the material to be dispensed, wherein the fastening mechanism comprises a locked state in which the fastening mechanism requires a key to move from the fastened configuration to the unfastened configuration, and an unlocked state in which the fastening mechanism is movable from the fastened configuration to the unfastened configuration without the presence of the key, wherein the fastening mechanism comprises a button, a release member, and a cooperating member, wherein the release member engages with the cooperating member in the fastened configuration to prevent the cover opening from the base, wherein the release member disengages from the cooperating member in the unfastened configuration to allow the cover to open from the base, wherein the release member is actuable by the button without the presence of the key to disengage the release member from the cooperating member when the fastening mechanism is in the unlocked state, and wherein the release member is actuable by the key to disengage the release member from the cooperating member when the fastening mechanism is in the locked state, wherein the fastening mechanism comprises a lock track and the button comprises a locking member, the locking member configured to move along the lock track during actuation of the button, and wherein the lock track comprises a catch that is configured to restrain movement of the locking member along the lock track when the fastening mechanism is in the locked state.

2. The dispenser of claim 1, wherein the fastening mechanism is actuable by the key to move the fastening mechanism between the locked and unlocked states.

3. The dispenser of claim 1, wherein the button is actuable in the unlocked state, and the button is unactuable in the locked state so the key is required to disengage the release member from the cooperating member in the locked state.

4. The dispenser of claim 3, wherein the button is actuable by pushing the button to move the button inwardly, and wherein the inward movement of the button is blocked in the locked state.

5. The dispenser of claim 1, wherein the fastening mechanism comprises one or more knobs, catches, or sliders that are located inside the dispenser and that are only accessible when the cover is open from the base, wherein the one or more knobs, catches, or sliders move the fastening mechanism between the locked and unlocked states.

6. The dispenser of claim 1, wherein the locking member is configured to flex as it travels along the lock track when the button is actuated, thereby exerting a force against the actuation of the button.

7. The dispenser of claim 1, wherein the locking member is movable between a first region in which the locking member is caught by the catch, and a second region in which the locking member is moved beyond the catch and so becomes free to move within the second region, the locking member being in the first region in the locked state and the second region in the unlocked state.

8. The dispenser of claim 7, wherein the lock track comprises an enclosure in which the locking member is constrained to move, and wherein the enclosure comprises an opening into which the key can be inserted to move the locking member between the first and second regions.

9. The dispenser of claim 8, wherein the fastening mechanism comprises a further one of the lock track, and a further one of the locking member, wherein the locking members extend downwardly, and wherein the lock tracks curve outwardly away from one another so that both locking members are flexed outwardly away from one another when the button is actuated downwardly.

10. The dispenser of claim 5, wherein the lock track comprises an enclosure in which the locking member is constrained to move, and wherein the enclosure comprises an opening into which the key can be inserted to move the locking member between the first and second regions, wherein the locking member is the slider, and is only accessible to move it between the first and second regions when the cover is open from the base.

11. The dispenser of claim 1, wherein the fastening mechanism comprises a base catch mounted on the base and a cover catch mounted on the cover, wherein the base and cover catches are configured to latch with one another in the fastened configuration to hold the cover to the base, and to separate from another in the unfastened configuration to allow the cover to open from the base, and wherein one of the base catch and the cover catch constitutes the release member, and the other of the base catch and the cover catch constitutes the cooperating member.

12. The dispenser of claim 11, wherein the release member comprises an aperture or protrusion, and the release member is deflectable by the key and by the button upon actuation of the button to disengage the aperture or the protrusion from a corresponding protrusion or aperture of the cooperating member.

13. The dispenser of claim 12, wherein the release member and/or cooperating member comprises a ramped surface configured to deflect the release member as the base and the cover are closed towards one another so that the protrusion will locate into the aperture.

14. The dispenser of claim 12, wherein the button comprises a hammer for acting on the release member to deflect the release member, and wherein the button or the base or the cover comprises a hole through which an end of the key is insertable to act against and deflect the release member.

15. The dispenser of claim 14, wherein the release member comprises a rearward edge and two apertures in a row parallel to the rearward edge, wherein the hammer is configured to act on the rearward edge intermediate of the two apertures, to deflect the two apertures of the release member out of engagement from two corresponding protrusions of the cooperating member.

16. The dispenser of claim 15, wherein the button or the base or the cover comprise the hole and a further hole, the hole and the further hole configured to receive two members of the key so the end of each member of the key acts against a corresponding part of the rearward edge of the release member to deflect the two apertures of the release member out of engagement from the two corresponding protrusions of the cooperating member.

17. The dispenser of claim 16, wherein the hole and the further hole are positioned at opposing sides of the button.

18. The dispenser of claim 10, wherein the release member is the cover catch, wherein the cooperating member is the base catch, and wherein the button is mounted on the base.

19. The dispenser of claim 1, further comprising the key.

* * * * *